US005739741A

United States Patent [19]

Hanazaki et al.

[11] Patent Number: 5,739,741

[45] Date of Patent: Apr. 14, 1998

[54] METHOD OF INTERRUPTING CURRENT IN FUSE AND FUSE STRUCTURE

[75] Inventors: Hisashi Hanazaki; Mitsuhiko Totsuka, both of Shizuoka, Japan

[73] Assignee: Yazaki Corporation, Tokyo, Japan

[21] Appl. No.: 701,732

[22] Filed: Aug. 22, 1996

Related U.S. Application Data

[63] Continuation of Ser. No. 495,106, Jun. 27, 1995, abandoned.

[30] Foreign Application Priority Data

Jun. 30, 1994 [JP] Japan ..... 6-149913

[51] Int. Cl.[6] ..... H01H 825/04; H01H 85/08

[52] U.S. Cl. ..... 337/290; 337/160; 337/198; 337/295

[58] Field of Search ..... 337/160–165, 337/195–198, 262, 295, 296, 290; 29/623; 439/621, 622

[56] References Cited

U.S. PATENT DOCUMENTS 3,116,390 12/1963 Goody et al. ..... 337/296
4,944,084 7/1990 Horibe et al. ..... 29/623
5,528,213 6/1996 Kondo et al. ..... 337/160

FOREIGN PATENT DOCUMENTS

A14241922 6/1993 Germany .
62-1349 1/1987 Japan .
5166453 7/1993 Japan .

*Primary Examiner*—Leo P. Picard
*Assistant Examiner*—Jayprakash N. Gandhi
*Attorney, Agent, or Firm*—Sughrue, Mion, Zinn, Macpeak & Seas, PLLC

[57] ABSTRACT

A metal chip of low-melting metal having a cavity is fixedly held by an embracing portion of a fusible portion of a fuse of a fusible metal conductor. The metal chip has a predetermined outer diameter, and by changing a diameter of a through hole defining the cavity, the volume of the cavity can be adjusted. By doing so, fusion characteristics of the fusible portion can be adjusted.

4 Claims, 4 Drawing Sheets

METHOD OF INTERRUPTING CURRENT IN FUSE AND FUSE STRUCTURE

This is a Continuation of Application Ser. No. 08/495,106 filed Jun. 27, 1995 now abandoned.

BACKGROUND OF THE INVENTION

1. Field of the Invention

This invention relates to a method of interrupting an electric current in a fuse used for protecting an electric circuit in an automobile or the like, and also relates to such a fuse structure. More specifically, the invention relates to a method of interrupting an electric current in a fuse of adjustable fusibility which positively breaks a circuit when a transient current occurs, and also relates to such a fuse structure.

2. Related Art

A fusible link (F/L) has heretofore been used as a fuse for protecting an electric circuit such as a motor load circuit of an automobile in which a transient current with a current flow rate of below about 200% flows. This fusible link is required to effectively function to protect the circuit when a burst current with a current flow rate of above 200% occurs as in dead short. Namely, the range of flow current can be divided into "a dead-short region" in which the flow current is larger than a boundary value (current flow rate of 200%), twice as large as the rated value, and "a rare-short region" in which the flow current is smaller than the boundary value. It has been desired to provide a fuse effective in both the dead-short region and the rare-short region.

More specifically, when a large transient current flows as in dead short, a circuit must be positively broken before damage to a load circuit, the fusion of a lead wire connected to the load circuit, the generation of smoke and so on occur.

For example, when opening and closing a power window of an automobile, a motor lock current in a medium current region (in which a current flow rate is below 200%) flows for about 10 seconds. In this case, it is necessary that the circuit not be broken even if such a motor lock current flows frequently.

There has been proposed a fuse of the type described having break-retarding characteristics as disclosed in Japanese Patent Unexamined Publication No. 5-166453.

This fuse 30 includes a pair of opposed connection portions 34, and a fusible portion 33 provided between the pair of connection portions 34, the fusible portion 33 having an embracing portion 32 fixedly holding a metal chip 31. The metal chip 31 is formed by extruding a low-melting temperature metal into a wire-like configuration and then by cutting it into a predetermined length.

A base material for the fusible portion 33 is a copper alloy as used for a conductor, and the fusible portion 33 has such a small cross-sectional area that it can be severed instantaneously when a large current flows through it. The metal chip 31 is made of tin lower in melting point than copper, and is heated by energization melt and diffuse into the fusible portion 33 to form an alloy phase. Therefore, in the medium-small current region, the fusible portion 33 is fused to be severed at the alloy phase higher in resistance than the copper alloy (base material).

The time of melting or fusion of the fuse (which has the low-melting metal such as tin and a tin-based alloy) by the flow current varies in accordance with the mass of the tin. In the fuse of this type, the fusion characteristics have heretofore been adjusted by changing the dimensions of the solid metal chip.

However, in a process of attaching the metal chip to the fusible portion of the fuse, a chip material has been cut into a predetermined length, and then the resulting chip has been secured to the fusible portion by clamping, and therefore the control of the dimensions of the chip of tin has been rather difficult. And besides, there is another problem that a plurality of kinds of clamping dies must be prepared to meet various outer sizes of the tin chips.

SUMMARY OF THE INVENTION

It is an object of this invention to overcome the above problems, and more specifically to provide a method of interrupting an electric current in a fuse, in which different fusion characteristics can be achieved with the use of metal chips having a predetermined outer size. Another object is to provide such a fuse structure.

The above object of the invention has been achieved by a method of interrupting an electric current in a fuse, the fuse comprising a fusible portion of electrically-conductive metal having a fusingly severable portion, a metal chip of low-melting metal for absorbing heat generated in the fusible portion, and an embracing portion holding the metal chip, wherein the metal chip with a predetermined outer diameter which has a cavity is embraced by the fusible portion; and by changing a volume of the cavity in the metal chip, fusion characteristics of the fusible portion are adjusted.

The above object of the invention has also been achieved by a fuse structure comprising a fusible portion of electrically-conductive metal having a fusingly severable portion, a metal chip of low-melting metal for absorbing heat generated in the fusible portion, and an embracing portion holding the metal chip; CHARACTERIZED in that the metal chip has a predetermined outer diameter, and has a cavity for adjusting fusion characteristics; and the metal chip is embraced by the fusible portion.

To effectively achieve the above object, the cavity is preferably a through hole formed axially through the metal chip, and the fusion characteristics of the metal chip are preferably adjusted by changing a diameter of the cavity.

In the fuse current-interrupting method of the invention, as well as the fuse structure of the invention, the metal chip with the predetermined outer diameter, having the cavity, is embraced by the fusible portion, and the fusion characteristics of the fusible portion can be adjusted by adjusting the volume of the cavity in the metal chip.

The metal chip with the predetermined outer diameter, having the cavity for adjusting the fusion characteristics, is embraced by the fusible portion. This cavity is defined by a through hole formed axially through the metal chip, and by changing the diameter of the through hole, the fusion characteristics of the metal chip can be adjusted.

With this construction, the metal chip of low-melting metal serves as a heat-absorbing member, and in a large current region, when the through hole defining the cavity has a large diameter, so that the metal chip has a reduced mass, the fusion time is shortened (quick-blow characteristics).

In a medium-small current region, when the through hole defining the cavity has a large diameter, so that the metal chip has a reduced mass, the formation of an adequate alloy phase as a result of diffusion of the metal chip of low-melting metal into the fusible portion of high-melting metal is retarded, and the time of fusion of the fusible portion is prolonged (slow-blow characteristics).

DETAILED DESCRIPTION OF THE PREFERRED EMBODIMENTS

A method of interrupting an electric current in a fuse according to the present invention, as well as a fuse structure of the invention, will now be described with reference to FIGS. 1 to 6.

Figure 1:
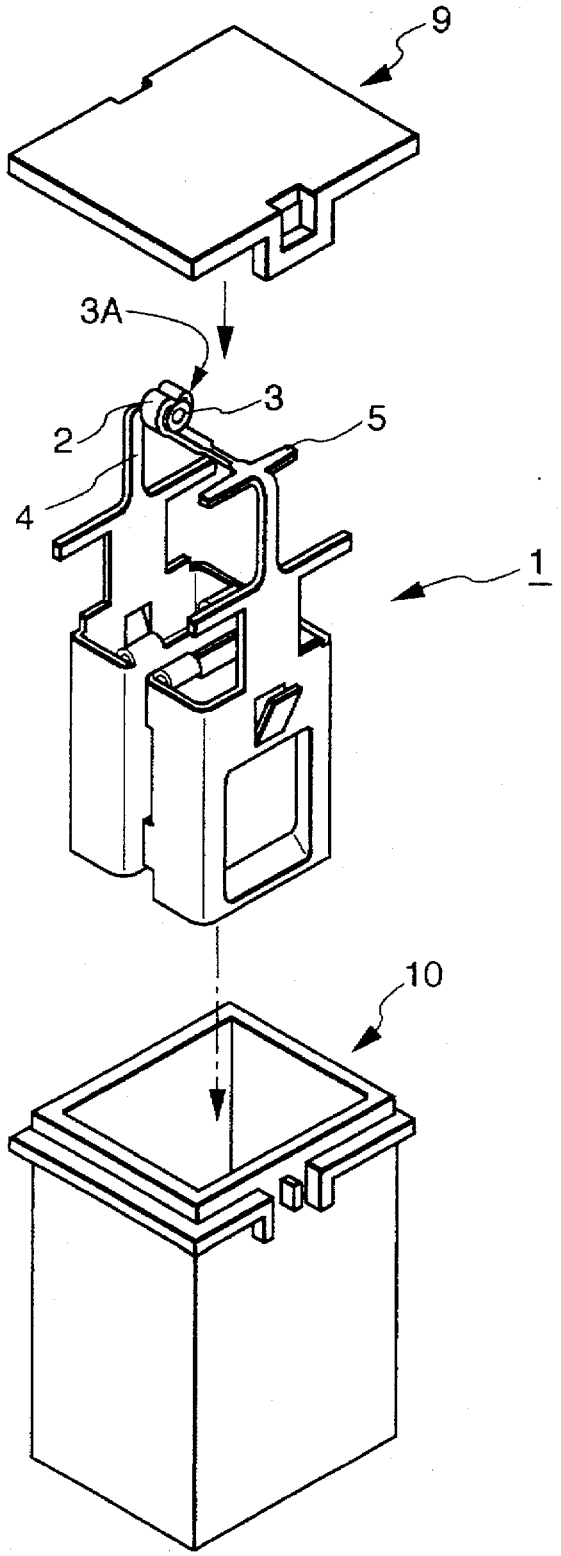
FIG. 1 is an exploded, perspective view of one preferred embodiment of a fuse of the present invention.

As shown in FIG. 1, the fuse 1 of this embodiment includes a relatively long, fusible portion 4 made of fusible metal, the fusible portion 4 having a relatively narrow cross-sectional area. The fusible portion 4 includes an embracing portion 2 fixedly holding a metal chip 3 of low-melting metal, and radiating plate portions 5, the metal chip 3 having a cavity or bore.

The fuse 1 of this construction is inserted into a housing 10 of a resin, and a transparent cover 9 is attached to the housing. The condition of the fuse 1 can be observed through the cover 9.

Figure 2:
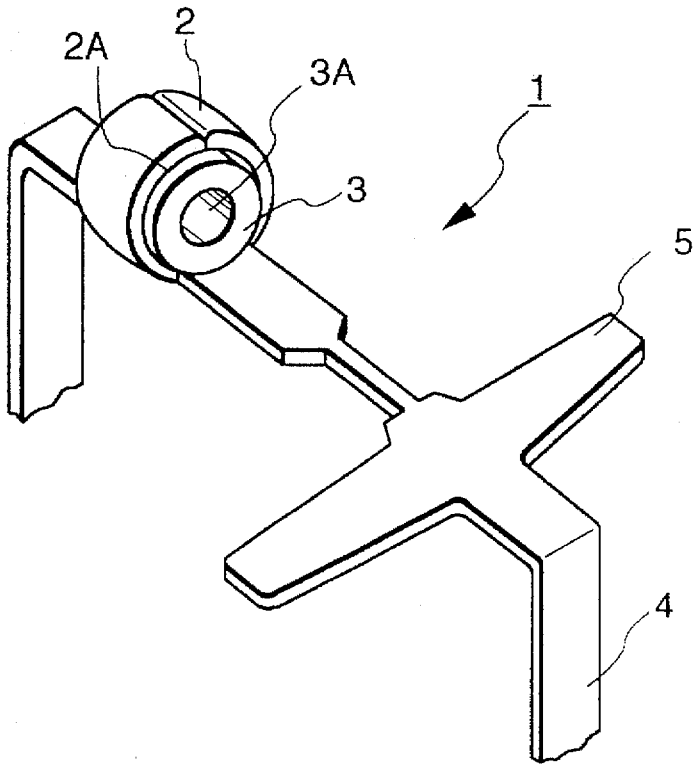
FIG. 2 is a perspective view of that portion of the fuse of FIG. 1 including a metal chip.

As shown in FIG. 2, the embracing portion 2 extends from opposite sides into a cylindrical shape around the metal chip 3 (which has the cavity 3A) to embrace the metal chip 3. The metal chip 3 is placed on a central portion of the embracing portion 2 developed into a flat configuration, and then the embracing portion 2 is deformed to embrace or clamp the metal chip 3, as described later. As a result of this clamping, an area 2A of contact between the metal chip 3 and the embracing portion 2 is formed. An electric current flows into the metal chip 3 through this contact area 2A, and also heat is transferred to the metal chip through the contact area 2A. Although the radiating plate portions 5 are provided in the illustrated embodiment, the provision of these radiating plate portions 5 may be omitted.

Figure 3:
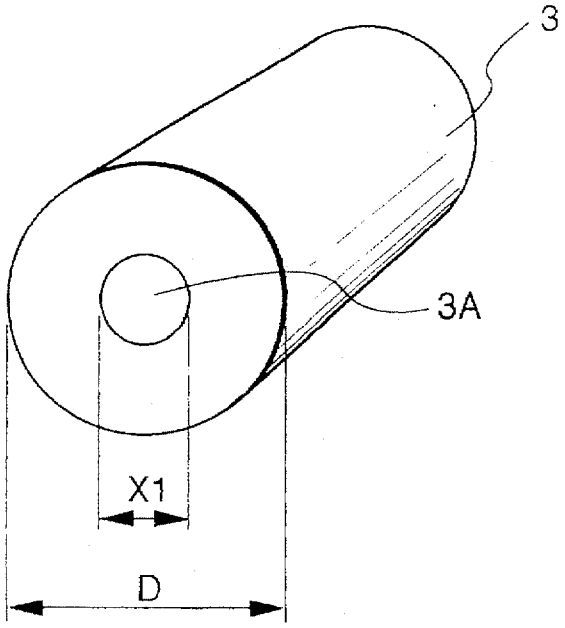
FIG. 3 is a perspective view of the metal chip having a small cavity.

In this embodiment, the metal chip 3 shown in FIG. 3 is in form of a hollow, cylindrical metal piece made of low-melting metal such as tin or a tin-based alloy. The metal chip 3 has a predetermined outer size or diameter D, and the cavity or bore 3A formed axially through the metal chip 3 has a relatively small diameter X1. The amount of reduction of the mass of the metal chip 3 as a result of formation of the cavity 3A is relatively small, so that the mass of the metal chip 3 is relatively large.

Figure 4:
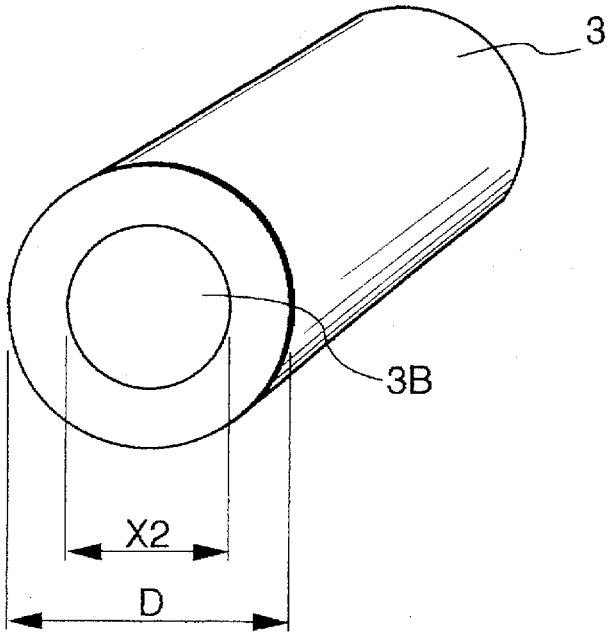
FIG. 4 is a perspective view of a modified metal chip having a larger cavity.

A modified metal chip 3 of the invention shown in FIG. 4 has the predetermined outer size or diameter D, and a cavity 3B has a relatively large diameter X2. Therefore, the amount of reduction of the mass of this metal chip 3 as a result of formation of the cavity 3B is relatively large, so that the mass of the metal chip 3 is relatively small.

In this embodiment, although the metal chips of the fuse of the invention have a cylindrical shape, they are not limited to a cylindrical shape, and may have a polygonal cross-sectional shape such as a triangular and a square cross-sectional shape.

Figure 5:
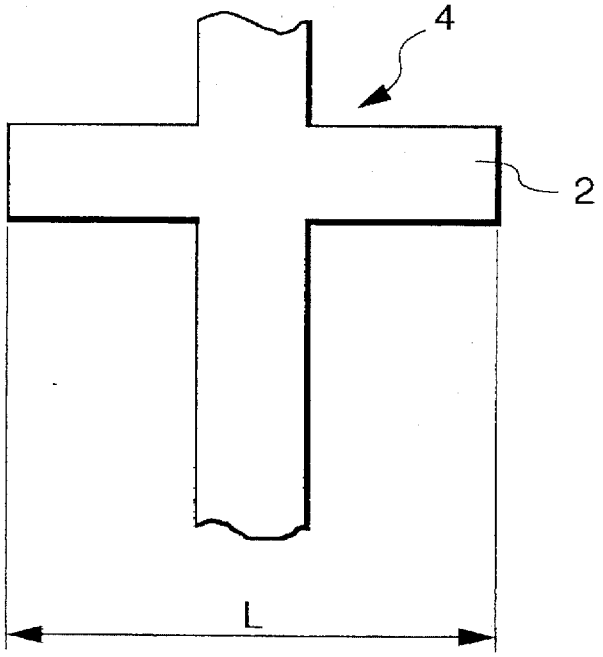
FIG. 5 is a developed view of a fusible portion of the fuse.

In FIG. 5 showing a developed view of the fusible portion 4 of this embodiment, the fusible portion 4 has the embracing portion 2 for embracing the metal chip as described above. Since the metal chips have the predetermined outer size, the embracing portion 2 has a predetermined length L. Therefore, only one kind of clamping die for the embracing operation need to be prepared, and thus there is no need to prepare a plurality of such clamping dies. Therefore, the fuses can be produced at lower costs.

Figure 6:
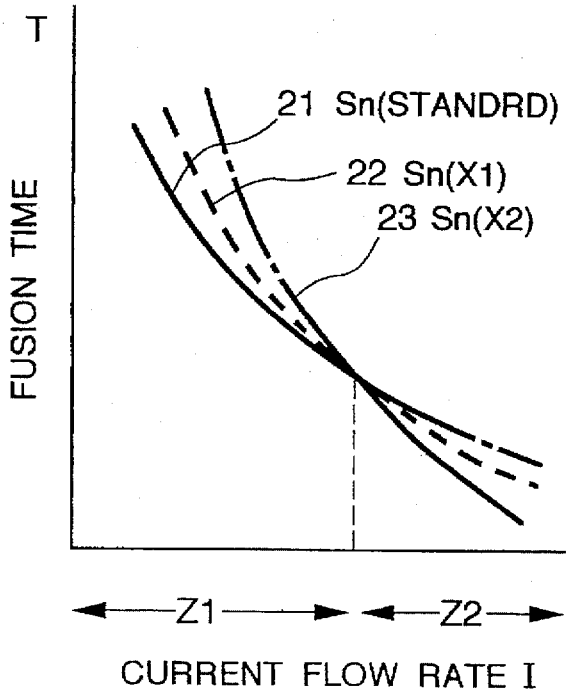
FIG. 6 is a diagram showing fusion characteristics of fuses.
Figure 7:
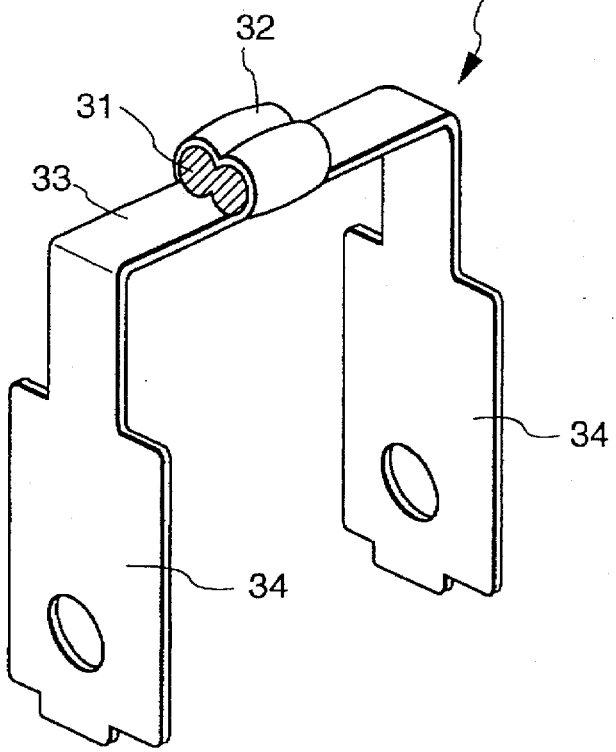
FIG. 7 PRIOR ART
FIG. 7 is a perspective view of a conventional fuse.

As shown in FIG. 6, with respect to the fusion characteristics of the fuses of the invention, the range of flow current is divided into "a large current region Z2" in which the flow current is larger than a boundary value (current flow rate of 200%) and "a medium-small current region Z1" in which the flow current is smaller than the boundary value. The metal chip of low-melting metal serves as a heat-absorbing member, and in the large current region Z2, when the cavity in the metal chip has the large diameter X2, the metal chip has a reduced mass, so that the fusion time is shortened as indicated by a characteristics curve 23. Namely, by increasing the volume of the cavity, quick-blow characteristics can be promoted.

In the medium-small current region Z1, when the cavity has a large diameter, the metal chip has a reduced mass, so that the formation of an alloy phase as a result of diffusion of the metal chip of low-melting metal into the fusible portion of high-melting metal is retarded. As a result, the time of fusion of the fusible portion is delayed. Namely, by increasing the volume of the cavity, slow-blow characteristics can be retarded.

Thus, in the fuse of the present invention, the fusion characteristics can be improved because of the provision of the cavity, as compared with the conventional fuse (whose fusion characteristics are represented by a characteristics curve 21) embracing the solid metal chip of low-melting metal. The volume of the cavity is adjusted by changing the diameter of the bore (or through hole) defining the cavity, and therefore the fusion characteristics can be easily adjusted.

Namely, in the medium-small current region Z1, the mass of the metal chip is reduced by increasing the diameter of the cavity, so that the time of fusion of the fusible portion is prolonged, thereby adjusting the slow-blow characteristics.

In the large current region Z1, by adjusting the mass of the metal chip, the time of fusion of the fusible portion is shortened to thereby adjust the quick-blow characteristics.

ADVANTAGEOUS EFFECTS OF THE INVENTION

As described above, in the fuse current-interrupting method of the invention, as well as the fuse structure of the invention, the metal chip with the predetermined outer diameter, having the cavity, is embraced by the fusible portion, and by adjusting the volume of the cavity in the metal chip, the fusion characteristics of the fusible portion can be adjusted.

The metal chip with the predetermined outer diameter, having the cavity for adjusting the fusion characteristics, is embraced by the fusible portion. The cavity is the through hole formed axially through the metal chip, and by changing the diameter of the through hole, the fusion characteristics of the metal chip can be adjusted.

With this arrangement, the fusion time can be positively shortened in the large current region (i.e., the dead-short region), and also can be positively prolonged in the medium-small current region (i.e., the rare-short region). Therefore, the safe, high-function fuse can be achieved.

And besides, since the metal chips have the predetermined outer diameter, the fuse can be processed by only one kind of clamping die, and therefore the processing cost can be reduced.

What is claimed is:

1. A fuse comprising:

a fusible portion made of electrically-conductive metal having a fusingly severable portion, a metal chip made of low-melting metal for absorbing heat generated in said fusible portion having a cavity for adjusting fusion characteristics of said metal chip; and a retaining portion for retaining said metal chip to said fusible portion, wherein the fusion characteristics of said metal chip are adjusted by changing a diameter of said cavity.

2. A fuse according to claim 1, wherein said cavity includes a through hole formed axially through said metal chip.

3. A fuse according to claim 2, wherein the fusion characteristics of said metal chip are adjusted by changing a diameter of said cavity.

4. A fuse according to claim 1, further comprising:

at least one radiating plate provided in vicinity of said fusible portion.

* * * * *